United States Patent [19]

Willermet et al.

[11] Patent Number: 4,896,635

[45] Date of Patent: Jan. 30, 1990

[54] FRICTION REDUCING ROCKER ARM CONSTRUCTION

[75] Inventors: Pierre A. Willermet, Livonia; John M. Pieprzak, Dearborn, both of Mich.

[73] Assignee: Ford Motor Company, Dearborn, Mich.

[21] Appl. No.: 290,114

[22] Filed: Dec. 27, 1988

[51] Int. Cl.[4] ..... F01M 1/06; F01M 9/10

[52] U.S. Cl. ..... 123/90.36; 123/90.41

[58] Field of Search ..... 123/90.33, 90.35, 90.36, 123/90.41, 90.44, 90.47

[56] References Cited

U.S. PATENT DOCUMENTS

| | | | |
|---|---|---|---|
| Re. 24,941 | 2/1961 | Latham | 123/90.36 |
| 2,338,726 | 1/1944 | Leake | 123/90.39 |
| 2,345,822 | 4/1944 | Leake | 123/90.39 |
| 2,522,326 | 9/1950 | Winter | 123/90.39 |
| 4,245,523 | 1/1981 | Wherry | 123/90.36 |
| 4,515,116 | 5/1985 | Hayashi | 123/90.36 |
| 4,523,551 | 6/1985 | Arai et al. | 123/90.36 |
| 4,662,323 | 5/1987 | Moriya | 123/90.36 |

FOREIGN PATENT DOCUMENTS

| | | | |
|---|---|---|---|
| 0023250 | 2/1981 | European Pat. Off. | 123/90.36 |
| 2408786 | 7/1979 | France | 123/90.33 |
| 0053712 | 4/1979 | Japan | 123/90.44 |

*Primary Examiner*—Charles J. Myhre
*Assistant Examiner*—Weilun Lo
*Attorney, Agent, or Firm*—Robert E. McCollum; Clifford L. Sadler

[57] ABSTRACT

A rocker arm is constructed with a fulcrum having at least a partially cylindrical bearing surface and a central passage for receiving therein a pressurized supply or lubricant or oil, the passage being intersected by radial holes or passages connected to the periphery or outer bearing surface of the fulcrum to define a clearance space between the fulcrum and rocker arm surrounding it, for the introduction of a film of oil or lubricant during the non-loading cycle of operation of the cam, a squeeze film effect being provided during the loading operation of the cam by the oil or lubricant being evacuated through a lower or ambient pressure outlet, a thin film remaining to floatingly mount the rocker arm upon the fulcrum, this being accomplished by the introduction of the oil or lubricant under a pressure greater than the forces generated when the cam is in contact on the cam base circle.

9 Claims, 1 Drawing Sheet

FRICTION REDUCING ROCKER ARM CONSTRUCTION

Figure 1:
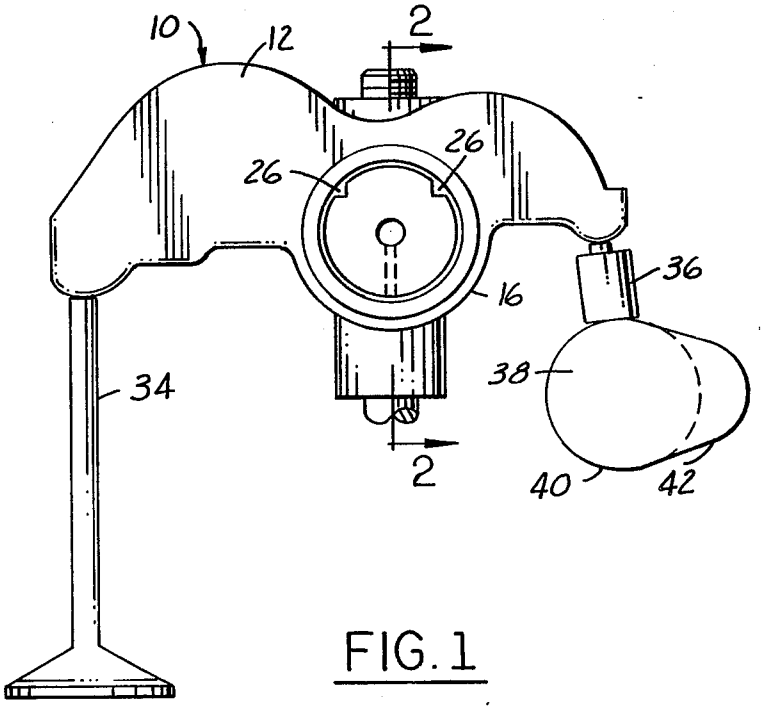

This invention relates in general to an automotive type engine, and more particularly to the construction of a rocker arm for use therein that reduces friction losses.

Rocker arm friction is an important part of total valve train friction in many designs. For example, it has been found to account for about 20% of total valve train friction at low speeds for a center pivot type rocker arm design. This particular invention is directed to a construction of a rocker arm that reduces friction in the contact area by the use of a squeeze film of lubricant between the rocker arm and its fulcrum. In the conventional rocker arm construction, such as a stud mounted one with a semi-cylindrical-shaped fulcrum, the rocker arm oscillates rather than rotates continuously, and low sliding speeds and high loads prevent the entrainment of a lubricant film in the rocker arm/fulcrum contact. Therefore, the rocker arm/fulcrum contact typically operates in the boundary or mixed lubrication regime, with resulting high friction.

Squeeze films are lubricating films between two bearing surfaces. These can be produced in several ways: by forcing oil between the surfaces at a pressure large enough to overcome the load on the bearing surfaces, or by allowing oil to flow into the area between the bearing surfaces when the bearing is unloaded. When the bearing is loaded, or when the pressure forcing oil into the gap is less than the pressure on the bearing, the oil is squeezed out of the bearing. As the oil film becomes thin, the rate at which it is squeezed out becomes progressively less. Accordingly, such films can last for a considerable time. If the bearing surfaces are smooth, very thin oil films can completely separate the two bearing surfaces. This allows the surfaces to move easily, i.e., with low friction, relative to one another.

This invention reduces rocker arm friction by producing a squeeze oil film between two conformal surfaces when the cam is on its base circle. Oil is forced into the contact area under pressure. In order to generate the film, the force generated by the oil pressure must be greater than the forces pressing the rocker arm against the fulcrum. Accordingly, entrainment of oil into the contact by the relative motion of contacting surfaces is not sufficient.

The oil film so produced functions as a squeeze film during the valve event when the rocker arm/fulcrum contact is under increased load. The presence of the squeeze film leads to reduced frictional losses and reduced wear. Test results on a center pivot-type rocker arm setup indicate that a squeeze film rocker arm eliminated about 50% of the rocker arm friction.

It is, therefore, a primary object of the invention to provide a rocker arm construction for an automotive type engine that reduces the friction between the hub of the rocker arm and its fulcrum.

It is a further object of the invention to construct the rocker arm described above in such a manner that oil lubricant under pressure can be introduced into the clearance space between the rocker arm and its fulcrum so that a squeeze film of lubricant is provided during load conditions to in effect float the rocker arm on the fulcrum and thereby reduce the friction between the relatively movable parts.

Figure 2:
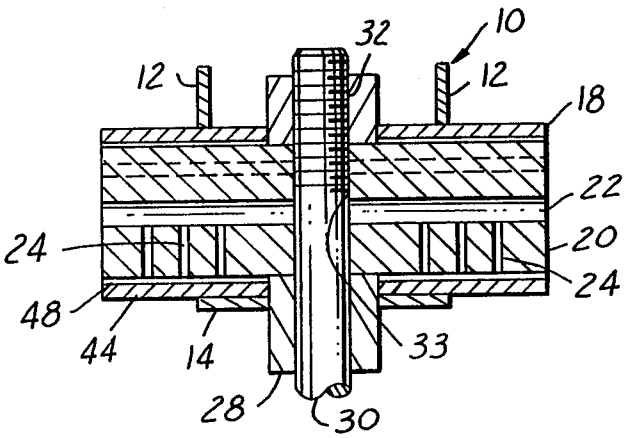

Other objects, features and advantages of the invention will become more apparent upon reference to the succeeding, detailed description thereof, and to the drawings illustrating the preferred embodiment thereof; wherein:

FIG. 1 is a side elevational view of a portion of a valve train with its rocker arm and fulcrum mounting constructed in accordance with the invention; and FIG. 2 is a cross-sectional view taken on a plane indicated by and viewed in the direction of the arrows II—II of FIG. 1.

The figures show a channel-shaped rocker arm 10 having a pair of upstanding sidewalls 12 that slightly converge towards one another. The sidewalls are joined integrally with a bottom wall 14 formed as shown in FIG. 1 with an arcuate bearing like portion 16. The rocker arm in this case is fixedly mounted on a cylindrical tube 18. The tube in turn receives therein a cylindrical fulcrum 20 that has a central or axial oil passage 22 intersected by a number of radially extending passages 24. The passage 22 is adapted to be connected to any suitable source of oil under pressure, such as the engine oil pump, for example. The passages 24 connect the central oil passage to the outer bearing surface or periphery of the fulcrum, as shown. The fulcrum also contains a pair of pressure relief openings 26 that are vented to the inlet of the supply line, not shown, for the oil or lubricant.

Completing the construction, the tubular member 18 and the bottom wall of the rocker arm 14 are both provided with aligned openings through which a spacer 28 is inserted. The spacer surrounds and threadedly receives a stud 30 that projects through a hole 32 in the spacer and a correspondingly aligned hole 33 in the fulcrum for rigid attachment of the assembly to a portion of the engine cylinder head. The openings are elongated in the conventional manner to permit a pivotal or oscillating movement of the rocker arm about the fulcrum 20. While the fulcrum is shown as cylindrical, it will be clear that it could be semi-cylindrical as well, or only partially cylindrical, within the scope of the invention.

As seen in FIG. 1, one end of the rocker arm is adapted to engage the end 34 of the stem of an engine valve, the opposite end in this case engaging a tappet 36. The tappet is contiguous to a cam member 38 fixed for rotation with the usual engine-driven camshaft, not shown. The cam member 38 has a base circle portion 40 and a cam contoured portion 42. When the tappet 36 is engaged with the base circle portion 40, oil under pressure is forced through passages 22, 24 to the load bearing side 44 of fulcrum 20. As stated previously, the oil pressure is made greater than the forces pressing the rocker arm up against the fulcrum. Accordingly, the oil forces the tube 18 and cylinder or fulcrum 20 apart on the load bearing side 44, producing an oil film between.

As best seen in FIG. 1, the oil is forced to flow circumferentially from the outlets of passages 24 at the load bearing side to the vent passages 26 on the non-load bearing side of the rocker arm/fulcrum and flows out through the pressure relief channels 26 to the inlet of the supply pump or other suitable reservoir.

In the case of a valve train using a mechanical tappet 36, the load over the base circle is nearly zero. Therefore, only a small bearing area is needed to form an oil film in the clearance space 48 between the fulcrum and rocker arm. In the case of the use of a hydraulic tappet, however, a significant load is produced when the cam/- tappet contact is on the base circle 40 because of the hydraulic pressure in the tappet that is used to pump up the tappet to maintain contact with the cam base circle. After the oil film is formed at the load bearing surface 44, the cam/tappet contact moves over the cam event, causing higher loads to be applied to the rocker arm fulcrum contact. The oil film is gradually squeezed out until the oil film thickness becomes comparable in dimensions to the surface roughness of the adjacent parts.

If the inner wall of the tube 18 and the outer surface of the fulcrum 20 are made very smooth and polished, then the fine surface finish allows the squeeze film to last longer before the oil film thickness becomes comparable in dimensions to the surface roughness. It should be noted that the distance from the oil inlet supply to the load bearing side 44 of the fulcrum circumferentially to the outlets 26 is such as to retain an oil film between the parts; i.e., the distance is such that the time it takes for oscillation of the rocker arm by the movement of the cam through its rotation is shorter than the time it would take for the oil to be completely vented through the outlets 26.

Experiments were conducted on hardward from an overhead valve engine with a hydraulic tappet. The dimensions of the fulcrum were 0.76 inches diameter by 2.4 inches long with a radial clearancce between the fulcrum and the tube upon which the rocker arm was mounted of 0.0003 inches. The surfaces of the fulcrum and the tube were finished to about 2 micro inches. A center pivot rocker arm geometry was used. The resultant data indicated that the squeeze film rocker arm eliminated about 50% of the rocker arm friction, as mentioned previously.

From the foregoing, it will be seen that the invention provides a rocker arm construction in which a squeeze film of lubricant is introduced between the rocker arm and its fulcrum during the no-load operation of the assembly, the loading of the rocker arm against its fulcrum providing a squeeze film effect to floatingly mount the rocker arm body upon the fulcrum, and thereby reduce frictional resistance to rotation between the two.

While the invention has been shown and described in its preferred embodiments, it will be clear to those skilled in the arts to which it pertains that many changes and modifications may be made thereto without departing from the scope of the invention. For example, several other improvements could be made for further reducing friction. These could include improving the supply of oil to the load bearing surface, optimizing the clearance space between the fulcrum and the tube surrounding it, optimizing the size of the bearing area, length and diameter, and using hardened components in place of softer metal.

We claim:

1. A friction reducing engine rocker arm construction comprising a rocker arm having a longitudinally extending body, the body having an opening therein at least partially circular in shape and defined by an annular wall portion of the body, a fulcrum having a mating portion at least partially circular in shape, the fulcrum being rotatably mounted in the opening with a slight radial clearance space between the wall and fulcrum, cam means having a no-load base circle portion and a load contoured portion, the cam means being engageable with the body to pivot the same about the fulcrum, the cam means is under no-load condition when contact between the cam means and body is made on the base circle portion of the cam means, the cam means loads the body into contact with and against one side of the fulcrum, and lubricant inlet means to supply lubricant under pressure to the clearance space at a pressure level greater than the no-load force of the body against the fulcrum whereby the body is essentially continuously floated upon the fulcrum by means of a film of lubricant therebetween, a vent for the lubricant circumferentially spaced from the inlet means whereby loading of the body by movement of the cam means to a position providing contact between the cam means and body on the contoured portion of the cam means effects a squeezing of a portion of the lubricant from the clearance space while retaining a thin film of lubricant therein to reduce frictional resistance to rotation between the parts.

2. A method of reducing frictional resistance to rotation between the body of a pivoting engine cam driven rocker arm and its fulcrum, consisting of providing an arcuate clearance space between the body and fulcrum and introducing lubricant into the space at a pressure level providing a force greater than the forces of the cam pressing the rocker arm body against the fulcrum so that the body is essentially continuously floated upon the fulcrum under no-load cam operating conditions, and providing an outlet for the lubricant located a circumferential distance from the point of introduction of the lubricant to the space whereby the lubricant is partially squeezed from the space during load operating conditions of the cam with a thin film of lubricant remaining between the body and fulcrum to reduce the frictional resistance to rotation of the body upon the fulcrum.

3. A rocker arm as in claim 1, wherein adjacent surfaces of the wall portion and fulcrum are essentially parallel and smooth and continuous over their lengths.

4. A rocker arm as in claim 1, wherein the thickness of the thin film under load conditions is essentially equivalent to the surface roughness of adjacent surfaces of the body and fulcrum.

5. A rocker arm as in claim 1, including a tubular member secured to the body between the body and the fulcrum, the clearance space being between the member and fulcrum.

6. A rocker arm as in claim 1, the fulcrum having an axial lubricant passage, and a number of other passages connecting the axial passage to the clearance space.

7. A rocker arm as in claim 6, including a pressure relief channel for venting the lubricant located circumferentially from the inlet a distance sufficient to delay venting of the lubricant to maintain a film of lubricant in the clearance space during the load stage of operation of the cam and rocker arm.

8. A rocker arm as in claim 1, engagement of the cam means with the rocker arm moving the rocker arm wall towards the one side of the fulcrum to define the one side as a load bearing side of the fulcrum with the opposite side being a non-load bearing side, rotation of the cam means to a location moving the base circle portion of the cam means out of contact with the rocker arm body loading the body against the fulcrum to provide the squeeze film of lubricant.

9. A rocker arm as in claim 3, wherein the thickness of the thin film under load conditions is essentially equivalent to the surface roughness of the adjacent surfaces of the body and fulcrum.

* * * * *